US008262409B2

(12) United States Patent
Chang

(10) Patent No.: US 8,262,409 B2
(45) Date of Patent: Sep. 11, 2012

(54) CONNECTION TERMINAL WITH A BASE WITH TWO UPWARDLY EXTENDING SECTIONS WITH ANGLED AND OBLIQUE EDGES TO CLAMP AN INTERNAL CONDUCTOR OF A COAXIAL CABLE

(75) Inventor: Pao-Chen Chang, Taipei (TW)

(73) Assignee: EZCONN Corporation, Taipei (TW)

( * ) Notice: Subject to any disclaimer, the term of this patent is extended or adjusted under 35 U.S.C. 154(b) by 0 days.

(21) Appl. No.: 13/116,047

(22) Filed: May 26, 2011

(65) Prior Publication Data

US 2012/0135637 A1 May 31, 2012

Related U.S. Application Data

(63) Continuation-in-part of application No. 12/955,155, filed on Nov. 29, 2010, now Pat. No. 8,137,134.

(51) Int. Cl.
*H01R 9/05* (2006.01)

(52) U.S. Cl. ..... 439/582

(58) Field of Classification Search ..... 439/578–585, 439/63

See application file for complete search history.

(56) References Cited

U.S. PATENT DOCUMENTS

| | | | | |
|---|---|---|---|---|
| 6,508,668 | B1 * | 1/2003 | Yamane | 439/582 |
| 6,790,082 | B2 * | 9/2004 | Obayashi | 439/582 |
| 7,367,840 | B2 * | 5/2008 | Chen et al. | 439/581 |
| 7,540,774 | B1 * | 6/2009 | Hung et al. | 439/582 |
| 7,704,096 | B2 * | 4/2010 | Liao et al. | 439/582 |
| 7,762,841 | B2 * | 7/2010 | Ho | 439/582 |
| 7,806,726 | B2 * | 10/2010 | Chen et al. | 439/582 |
| 7,874,870 | B1 * | 1/2011 | Chen | 439/582 |

* cited by examiner

*Primary Examiner* — Chandrika Prasad
(74) *Attorney, Agent, or Firm* — Rosenberg, Klein & Lee

(57) ABSTRACT

A coaxial cable connector includes: a connection terminal having a base section, a first extension section upward extending from a first edge of the base section, a second extension section upward extending from a second edge of the base section and spaced from the first extension section; an insulating member having an insulating main body for supporting the base section of the connection terminal; and a case for supporting the insulating main body of the insulating member. The first and second extension sections are bendable by means of a bending force applied to the insulating member and the case, whereby the first and second extension sections are urged to securely clamp an internal conductor of a coaxial cable at multiple points so as to electrically connect the connection terminal with the internal conductor of the coaxial cable.

3 Claims, 7 Drawing Sheets

CONNECTION TERMINAL WITH A BASE WITH TWO UPWARDLY EXTENDING SECTIONS WITH ANGLED AND OBLIQUE EDGES TO CLAMP AN INTERNAL CONDUCTOR OF A COAXIAL CABLE

CROSS-REFERENCE

This is a continuation-in-part of application Ser. No. 12/955,155, filed 29 Nov. 2010, which is now pending.

BACKGROUND OF THE INVENTION

1. Field of the Invention

The present invention relates generally to a coaxial cable connector, and more particularly to a coaxial cable connector in which the connection terminal can be securely connected with an internal conductor of a coaxial cable for reliable transmission of electrical signals.

2. Description of the Related Art

Numerous coaxial cables are used for the internal wiring of IT devices such as laptop computers and compact electronic devices such as home electric appliances, and such coaxial cables are usually used by being electrically connected to the respective conductors of other cables, substrates or the like.

In order to electrically connect such coaxial cables to, for example, a conductor of another cables, conventionally, internal conductors of the respective coaxial cables are one by one soldered to the conductor of other corresponding cables. As a result, internal conductors of coaxial cables were electrically connected to the conductors of other cables.

Nevertheless, with this electrical connection method, connection errors during the soldering process would of ten occur, and there is a problem in that the electrical connection between the internal conductors of coaxial cables and the conductors of other cables could not be conducted with precision.

Moreover, since the soldering process is complicated, there is a problem in that much time is required for the connection process, and that the loss is great due to failures of the connection process.

In order to overcome such problems, conventionally, a coaxial cable connector has been proposed as a device for electrically connecting the internal conductors of coaxial cables and the conductors of other cables.

U.S. Pat. No. 6,790,082 discloses a coaxial cable connector including a connection terminal to be connected to an internal conductor of a coaxial cable, and a metal shell for supporting the connection terminal via an insulator. The connection terminal is bent with respective bending forces of the shell and the insulator to make a pair of contact plates of the connection terminal retain the internal conductor of the coaxial cable. Accordingly, electrical connection is established between the internal conductor of the coaxial cable and the connection terminal.

In the above structure, the internal conductor of the coaxial cable is clamped from upper and lower sides by the pair of contact plates to establish the electrical connection between the internal conductor of the coaxial cable and the connection terminal. However, the internal conductor of the coaxial cable can be hardly securely retained by means of the contact plates. This often leads to poor contact between the internal conductor and the contact plates. As a result, it cannot be ensured that the contact plates are lastingly electrically connected with the internal conductor of the coaxial cable and the quality of signal transmission will be affected.

SUMMARY OF THE INVENTION

A primary object of the present invention is to provide a coaxial cable connector, which can be effectively mechanically and electrically connected with an internal conductor of a coaxial cable.

To achieve the above and other objects, the coaxial cable connector of the present invention includes: a connection terminal having a base section, a first extension section upward extending from a first edge of the base section, a second extension section upward extending from a second edge of the base section and spaced from the first extension section; an insulating member having an insulating main body for supporting the base section of the connection terminal; and a case for supporting the insulating main body of the insulating member. The first and second extension sections are bendable by means of a bending force applied to the insulating member and the case, whereby the first and second extension sections are urged to securely clamp an internal conductor of a coaxial cable at multiple points so as to electrically connect the connection terminal with the internal conductor of the coaxial cable.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
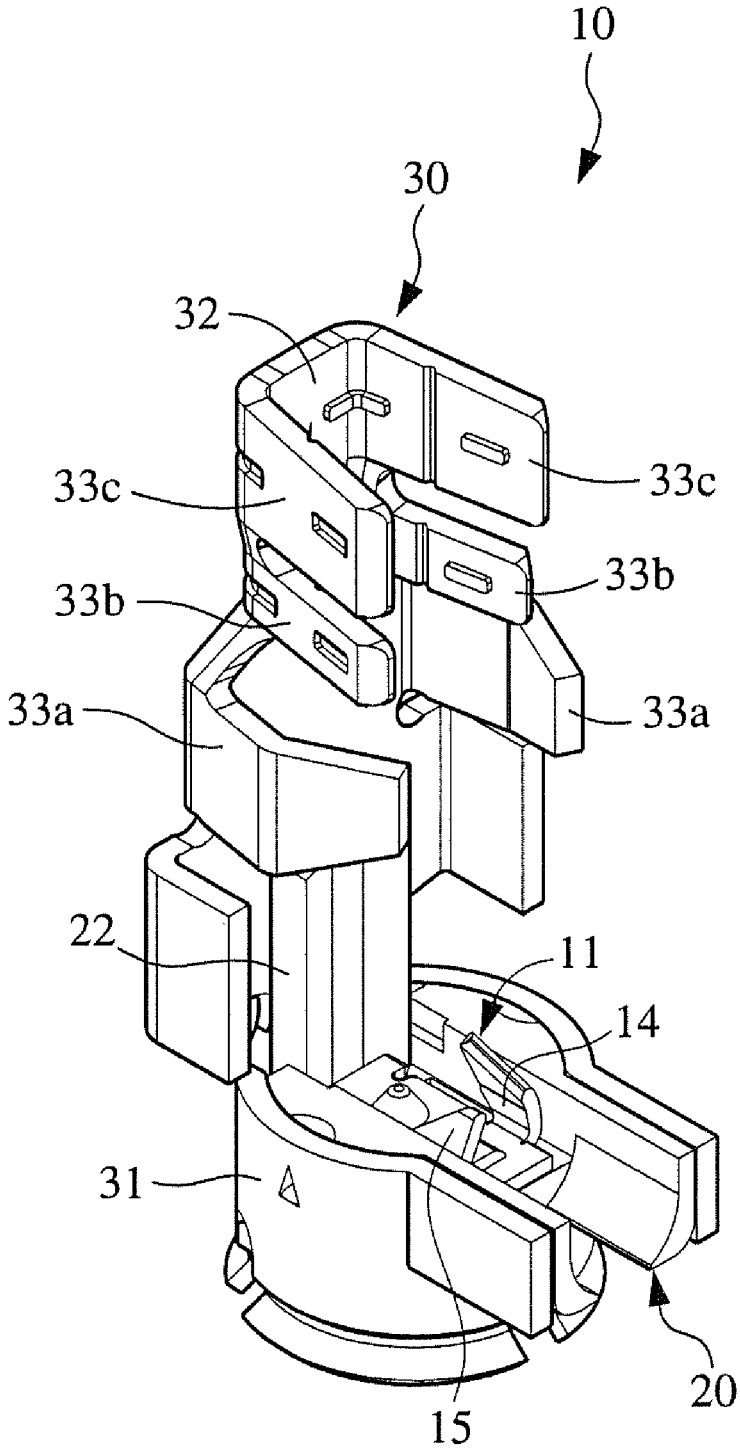
FIG. 1 is a perspective assembled view of the coaxial cable connector of the present invention.
Figure 2:
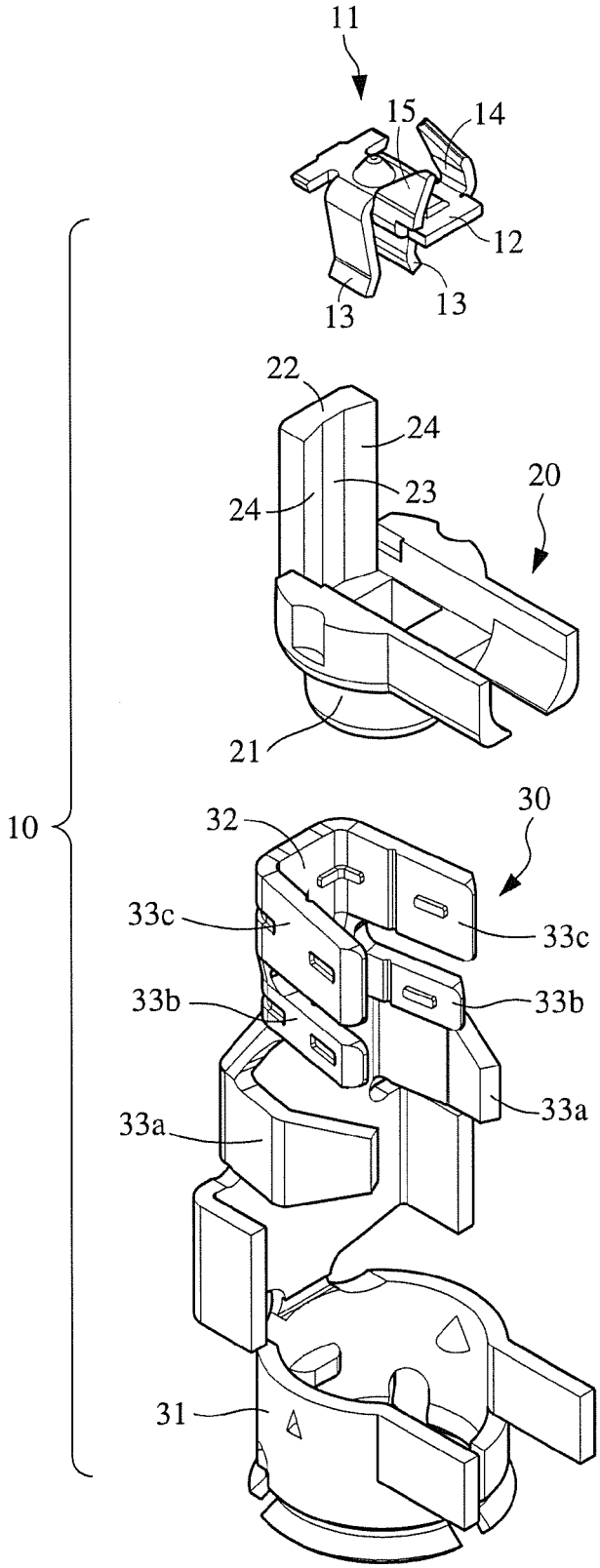
FIG. 2 is a perspective exploded view of the coaxial cable connector of the present invention.

Please refer to FIGS. 1 and 2. The coaxial cable connector 10 includes a connection terminal 11, an insulating member 20 and a metal case 30.

Figure 3:
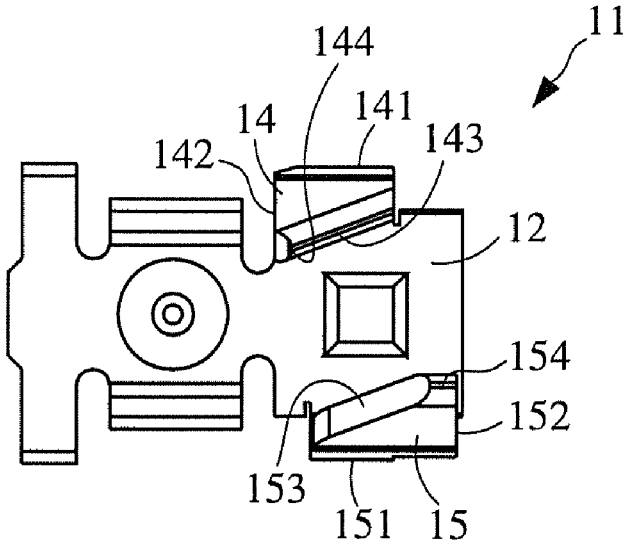
FIG. 3 is a top view of the connection terminal of the coaxial cable connector of the present invention.
Figure 4:
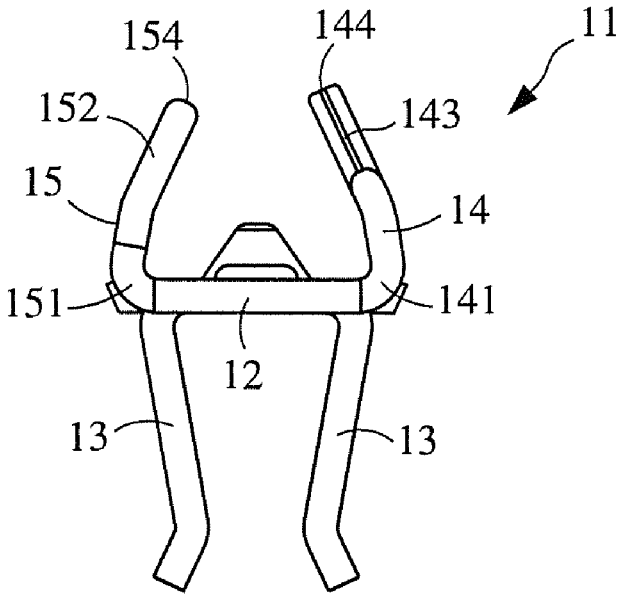
FIG. 4 is a right view of the connection terminal of the coaxial cable connector of the present invention.

Referring to FIGS. 3 and 4, the connection terminal 11 is connectable to an internal conductor of a coaxial cable. The connection terminal 11 includes: a base section 12; a pair of connection sections 13 respectively downward extending from two sides of the base section 12; a first extension section 14 upward extending from a first edge of the base section 12, the first extension section 14 having a reference edge 141 connected with the first edge of the base section 12, an outer edge 142 upward extending from an edge of the reference edge 141 by a predetermined angle and an oblique edge 143 upward extending from the edge of the reference edge 141 by a predetermined angle, the outer edge 142 and the oblique edge 143 being connected to form a continuous edge; and a second extension section 15 upward extending from a second edge of the base section 12. The first and second extension sections 14, 15 are positioned on two sides of the base section 12 and spaced from each other. The second extension section 15 has a reference edge 151 connected with the second edge of the base section 12, an outer edge 152 upward extending from an edge of the reference edge 151 by a predetermined angle and an oblique edge 153 upward extending from the edge of the reference edge 151 by a predetermined angle. The outer edge 152 and the oblique edge 153 are connected to form a continuous edge. In practice, the oblique edge 143 of the first extension section 14 corresponds to the oblique edge 153 of the second extension section 15.

Figure 5:
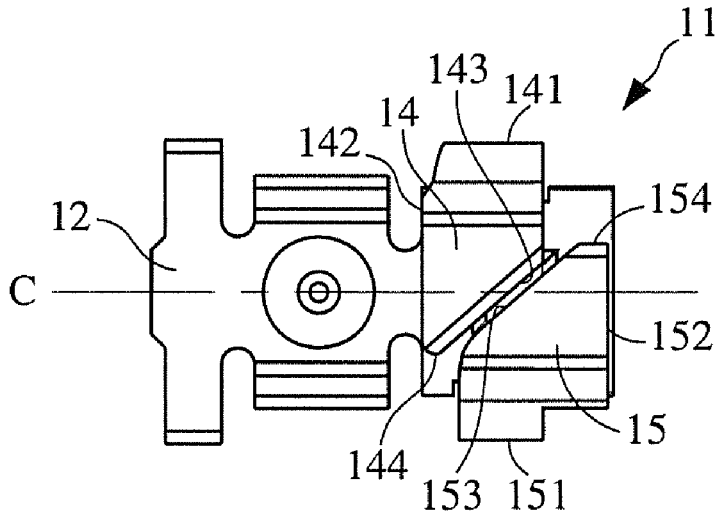
FIG. 5 is a top view of the connection terminal of the coaxial cable connector of the present invention, in which the connection terminal is bent.
Figure 6:
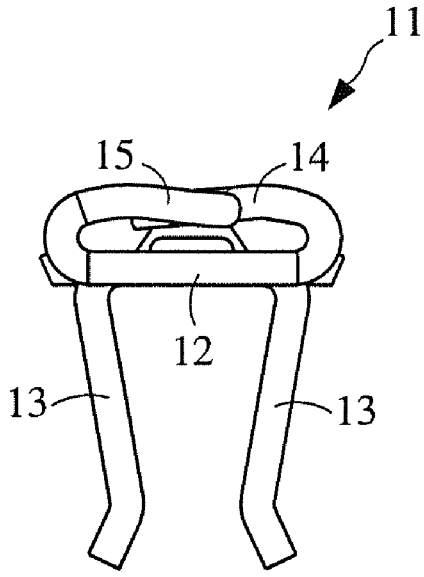
FIG. 6 is a right view of the connection terminal of the coaxial cable connector of the present invention, in which the connection terminal is bent.

When a downward press force is applied to the first and second extension sections 14, 15, the first and second extension sections 14, 15 are bent into a state as shown in FIGS. 5 and 6.

The base section 12 and the first and second extension sections 14, 15 define a space for accommodating the internal conductor of the coaxial cable. A central line C is defined on the base section 12 between the first and second extension sections 14, 15. After the first and second extension sections 14, 15 are bent, top ends 144, 154 of the first and second extension sections 14, 15 exceed the central line C of the base section 12.

The insulating member 20 is disposed between the connection terminal 11 and the metal case 30. The insulating member 20 has an insulating main body 21 for supporting the base section 12 of the connection terminal 11. The insulating member 20 further has an insulating bendable section 22 upward extending from one side of the insulating main body 21. The insulating bendable section 22 can be bent toward the internal conductor 44 of the coaxial cable. An inner wall face of the insulating bendable section 22 has a plane face section 23 and a pair of slope sections 24 positioned on two sides of the plane face section 23.

The metal case 30 has a case main body 31 for supporting the insulating main body 21 of the insulating member 20. The metal case 30 further has a case bendable section 32 positioned in parallel to the insulating bendable section 22 of the insulating member 20. The insulating bendable section 22 is bendable by means of a bending force applied to the case bendable section 32. The metal case 30 further has first connection sections 33*a* formed on two sides of the case bendable section 32.

In addition, the metal case 30 further has second connections 33*b* formed on two sides of the case bendable section 32 and third connection sections 33*c* also formed on two sides of the case bendable section 32.

Figure 7A:
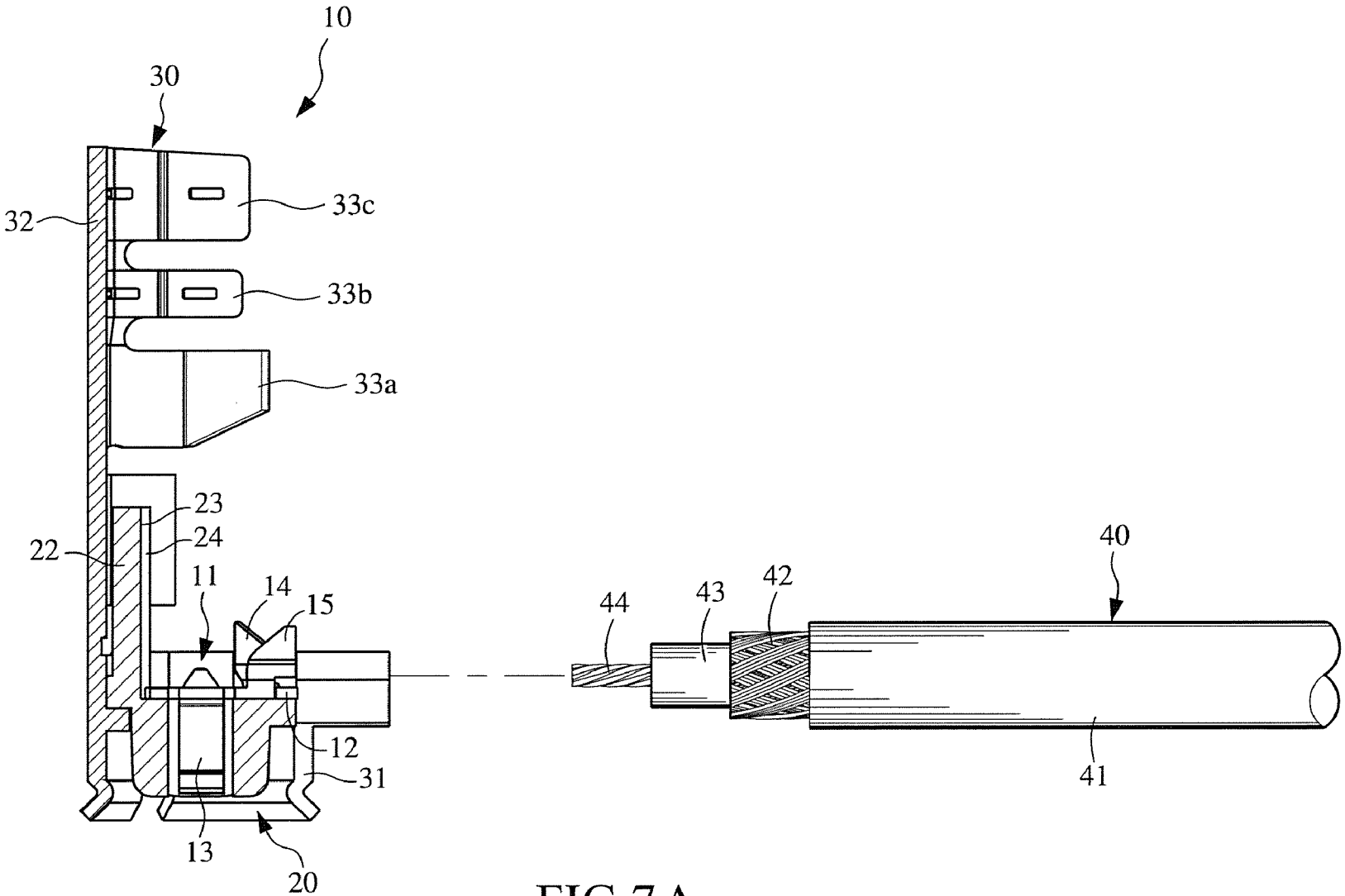
FIGS. 7A to 7D show the installation process of the coaxial cable on the coaxial cable connector of the present invention.
Figure 7B:
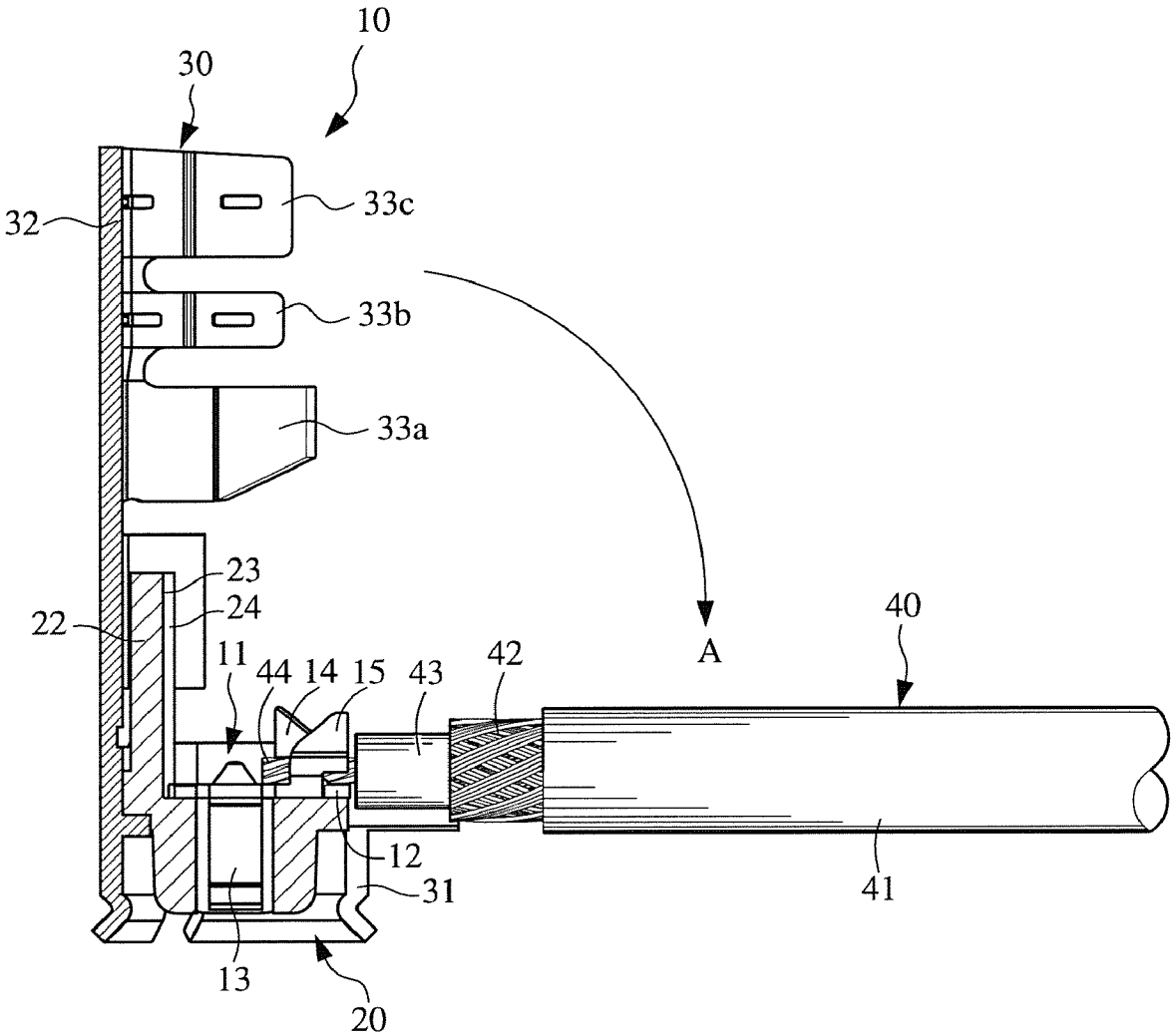

FIGS. 7A to 7D show the installation process of the coaxial cable 40 on the coaxial cable connector 10. The skin 41 of a free end of the coaxial cable 40 is partially removed to expose an external conductor 42, an insulator 43 and an internal conductor 44. In a first step, the coaxial cable 40 is inserted into the connection terminal 11 of the coaxial cable connector 10 as shown in FIG. 7A. At this time, the internal conductor 44 of the coaxial cable 40 is positioned between the base section 12 and the first and second extension sections 14, 15 as shown in FIG. 7B.

Figure 7C:
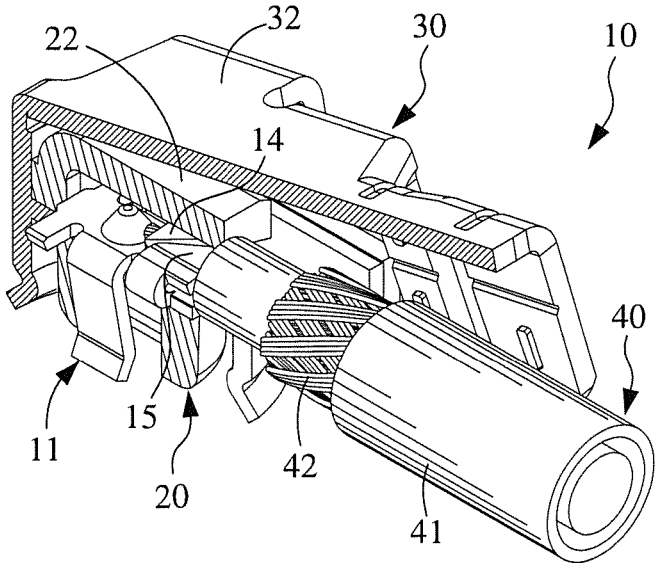
Figure 7D:
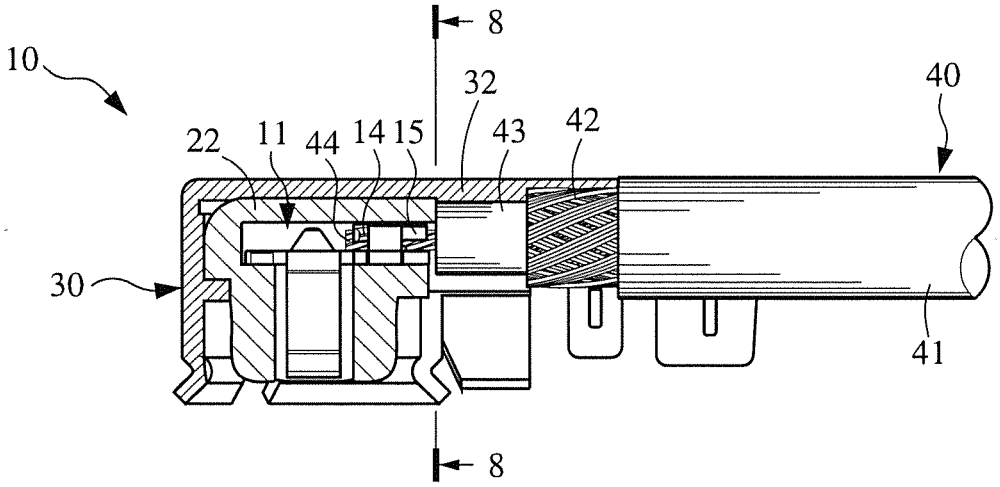
Figure 8:
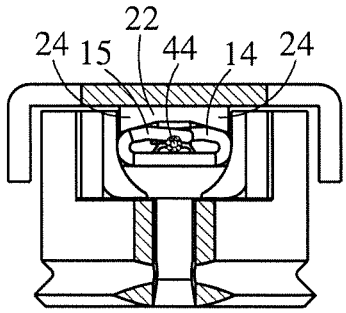
FIG. 8 is a sectional view taken along line 8-8 of FIG. 7D.

Then, a force in the direction of arrow A is applied to the metal case 30 to forcedly bend the case bendable section 32 of the metal case 30 and the insulating bendable section 22 of the insulating member 20 toward the internal conductor 44 of the coaxial cable 40. When bent, the slope sections 24 of the insulating bendable section 22 push the first and second extension sections 14, 15 to move toward the internal conductor 44 (as shown in FIG. 7C). Accordingly, the first and second extension sections 14, 15 of the connection terminal 11 are urged to securely clamp the internal conductor 44 of the coaxial cable 40 at multiple points. Under such circumstance, the connection terminal 11 is reliably mechanically and electrically connected with the internal conductor 44 of the coaxial cable 40 as shown in FIGS. 7D and 8.

Moreover, the case bendable section 32 is securely connected with the case main body 31 via the first connection sections 33*a*. In addition, the case bendable section 32 and the second connection sections 33*b* together hold the external conductor 42 of the coaxial cable 40. Also, the case bendable section 32 and the third connection sections 33*c* together hold the skin 41 of the coaxial cable 40. Accordingly, the coaxial cable connector 10 can be tightly connected with the free end of the coaxial cable 40.

The above embodiment is only used to illustrate the present invention, not intended to limit the scope thereof. It is understood that many changes or modifications of the above embodiment can be made by those who are skilled in this field without departing from the spirit of the present invention. The scope of the present invention is limited only by the appended claims.

What is claimed is:

1. A coaxial cable connector comprising:

a connection terminal having:

a base section;

a first extension section upward extending from a first edge of the base section, the first extension section having a reference edge connected with the first edge of the base section, an outer edge upward extending from an edge of the reference edge by a predetermined angle and an oblique edge upward extending from the edge of the reference edge by a predetermined angle, the outer edge and the oblique edge being connected to form a continuous edge; and a second extension section upward extending from a second edge of the base section, the first and second extension sections being positioned on two sides of the base section and spaced from each other, the second extension section having a reference edge connected with the second edge of the base section, an outer edge upward extending from an edge of the reference edge by a predetermined angle and an oblique edge upward extending from the edge of the reference edge by a predetermined angle, the outer edge and the oblique edge being connected to form a continuous edge, the base section and the first and second extension sections defining a space for accommodating an internal conductor of a coaxial cable;

an insulating member having an insulating main body for supporting the base section of the connection terminal, an insulating bendable section upward extending from one side of the insulating main body; and a case for supporting the insulating main body of the insulating member, the first and second extension sections being bendable by means of a bending force applied to the case and the insulating member, whereby the first and second extension sections are urged to securely clamp the internal conductor of the coaxial cable at multiple points so as to reliably mechanically and electrically connect the connection terminal with the internal conductor of the coaxial cable.

2. The coaxial cable connector as claimed in claim 1, wherein a central line is defined on the base section between the first and second extension sections, after the first and second extension sections are bent, top ends of the first and second extension sections exceeding the central line of the base section.

3. The coaxial cable connector as claimed in claim 1, wherein an inner wall face of the insulating bendable section has a plane face section and a pair of slope sections positioned on two sides of the plane face section, when a bending force is applied to the insulating bendable section, the slope sections of the insulating bendable section pushing the first and second extension sections to provide sufficient clamping force for the first and second extension sections and the internal conductor of the coaxial cable.

* * * * *